US006528931B1

(12) United States Patent
Umehara et al.

(10) Patent No.: US 6,528,931 B1
(45) Date of Patent: Mar. 4, 2003

(54) ELECTRIC LIGHT BULB WITH BASE HELD BY POSITIONING RING HAVING ELASTIC PIECES AND WELD PIECES

(75) Inventors: Masayuki Umehara, Shimizu (JP); Kazumasa Sugiyama, Shimizu (JP); Hitoshi Kawasaki, Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 427 days.

(21) Appl. No.: 09/050,558

(22) Filed: Mar. 31, 1998

(30) Foreign Application Priority Data

Apr. 3, 1997 (JP) ..... 9-085253

(51) Int. Cl.[7] ..... H01J 5/48
(52) U.S. Cl. ..... 313/318.01; 313/318.1
(58) Field of Search ..... 313/318.01, 318.02, 313/318.03, 318.05, 318.08, 318.09, 318.1

(56) References Cited

U.S. PATENT DOCUMENTS 4,547,838 A * 10/1985 Wakimizu ..... 362/211
4,769,574 A 9/1988 Nagasawa et al. ..... 313/318
4,879,491 A 11/1989 Hirozumi et al. ..... 313/318
5,216,319 A * 6/1993 Van Heeswijk ..... 313/318
5,654,608 A * 8/1997 Westemeyer et al. ..... 313/634

* cited by examiner

*Primary Examiner*—Vip Patel
*Assistant Examiner*—Joseph Williams
(74) *Attorney, Agent, or Firm*—Sughrue Mion, PLLC

(57) ABSTRACT

An electric light bulb with a base 1, including a positioning ring 7 adapted to be fitted onto and mounted to a cylindrical-shaped base 2 which holds a glass bulb 3 enclosing therein filaments 6. The positioning ring includes elastic pieces 11 and weld pieces 12 formed on a fitting hole 8, through which the base is inserted, the elastic pieces being adapted to resiliently abut against an outer peripheral surface of the base, the weld pieces being adapted to be welded to the outer peripheral surface of the base. The weld pieces 12 are securely welded to the outer peripheral surface of the base after the elastic pieces are made to abut against the outer peripheral surface of the base.

7 Claims, 7 Drawing Sheets

ELECTRIC LIGHT BULB WITH BASE HELD BY POSITIONING RING HAVING ELASTIC PIECES AND WELD PIECES

BACKGROUND OF THE INVENTION

1. Field of the Invention

The present invention relates to a novel electric light bulb with a base, and more particularly, to a technology which eliminates harming the environment by mounting a positioning ring to a base not by soldering but by welding and which can make a mount position of the positioning ring stable.

2. Description of the Related Art

There are electric light bulbs with a base, which is cylindrical-shaped to hold a glass bulb with filaments enclosed therein, and on which a positioning ring is fitted and mounted. Such electric light bulbs with a base are mainly used for light utensils for automobiles, and constructed such that the positioning ring abuts against a reference surface provided on a bulb support portion of the light utensil to precisely control a position of filaments.

One example of such conventional electric light bulbs with a base "a" is shown in FIG. 9.

A glass bulb "d" with filaments "c" enclosed therein is fixed to one end of a metallic, cylindrical-shaped base "b", and a positioning ring "e" is fitted onto and secured to the base "b".

Securement of the positioning ring "e" to the base "b" is effected by soldering to an outer peripheral surface of the base "b" an entire periphery of an opening edge of a fitting hole "f" formed on the positioning ring "e".

The conventional electric light bulb "a" with a base involves a problem that lead contained in solder harms the environment since securement of the positioning ring "e" to the base "b" is effected by soldering of the entire periphery of the opening edge of the fitting hole "f".

SUMMARY OF THE INVENTION

It is an object of the invention to eliminate ill effects on the environment by mounting the positioning ring to the base not by soldering but by welding and enable making the mount position of the positioning ring stable.

To attain the above object, the invention provides an electric light bulb with a base, in which elastic pieces and weld pieces are formed on a fitting hole of the positioning ring, through which the base is inserted, the elastic pieces being adapted to resiliently abut against an outer peripheral surface of the base, the weld pieces being adapted to be welded to the outer peripheral surface of the base, the weld pieces being securely welded to the outer peripheral surface of the base after the elastic pieces are made to abut against the outer peripheral surface of the base to be positioned.

Accordingly, with respect to the electric light bulb with a base of the present invention, the weld pieces are welded to the outer peripheral surface of the base to secure the positioning ring to the base, so that the use of solder is eliminated not to harm the environment. Also, the elastic pieces are provided separately from the weld pieces, and welding of the weld pieces is carried out in a state, in which the elastic pieces are made to resiliently abut against the outer peripheral surface of the base to be positioned, so that the positioning ring is prevented from going out of position relative to the base during welding operation and so it is possible to make the mount position of the positioning ring stable.

BRIEF DESCRIPTION OF THE DRAWINGS

The invention, together with objects and advantages thereof, may best be understood by reference to the following description of the presently preferred embodiments together with the accompanying drawings in which:

FIG. 2 is an enlarged, cross sectional view of essential parts of the first embodiment;

FIG. 3 is an enlarged, cross sectional view of other essential parts of the first embodiment;

FIG. 4 is an enlarged, perspective view of a positioning ring in the first embodiment;

FIG. 5 is an enlarged, cross sectional view taken along the line V—V of FIG. 4;

FIG. 6 is an enlarged, side elevational view of a weld piece;

FIG. 8 is an enlarged, perspective view of a positioning ring in the second embodiment.

DETAILED DESCRIPTION OF THE PREFERRED EMBODIMENTS

Figure 1:
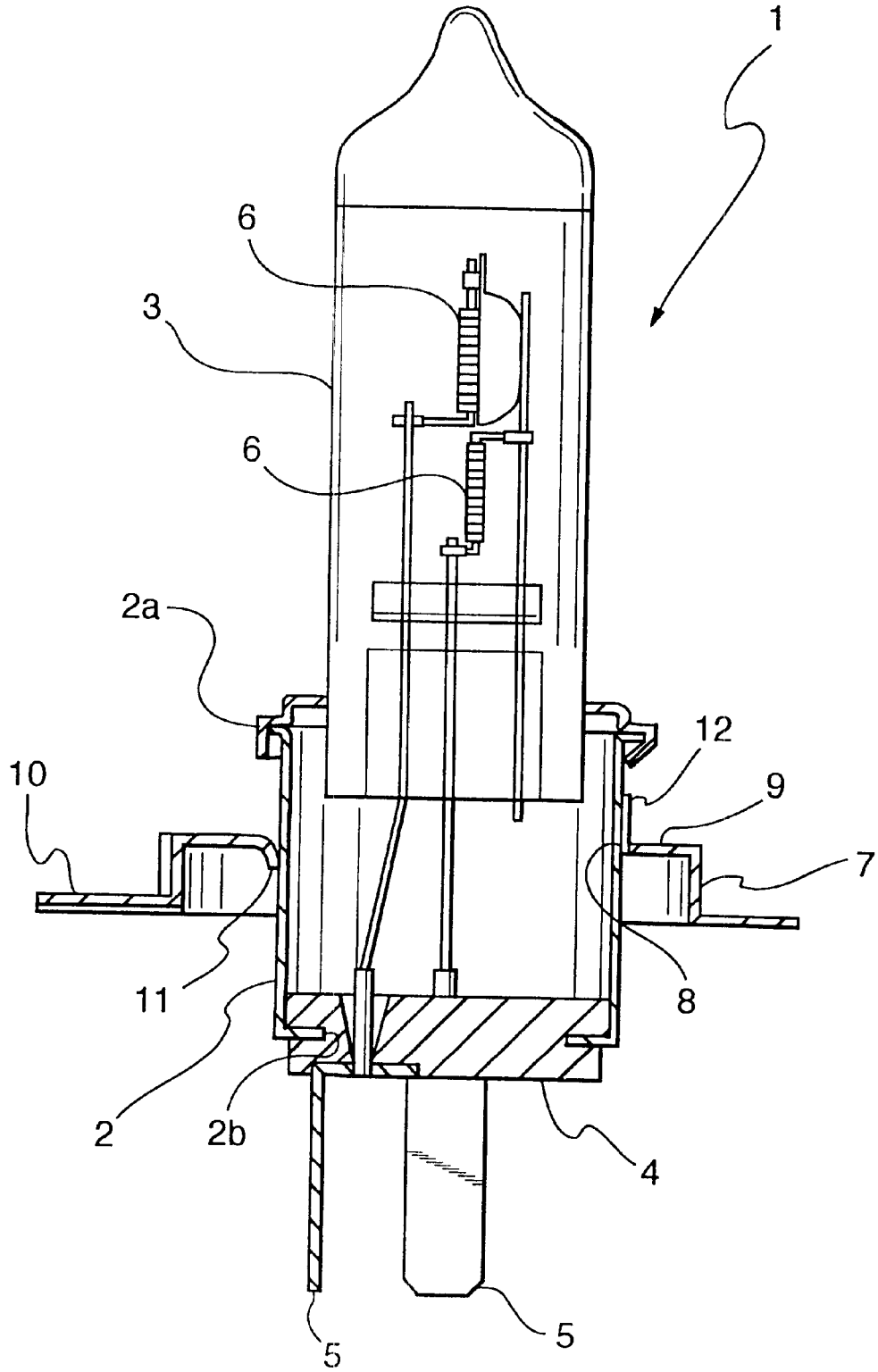
FIGS. 1 to 6 show a first embodiment of an electric light bulb with a base, according to the invention, FIG. 1 being a vertical cross sectional view of the first embodiment.
Figure 2:
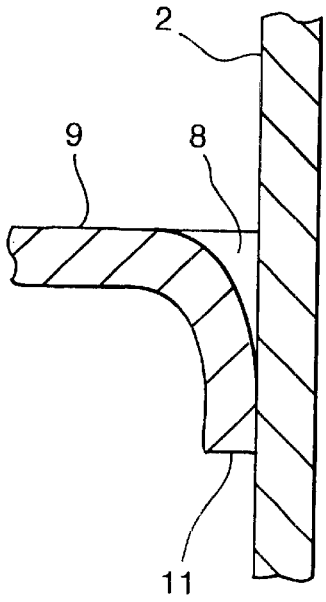
Figure 3:
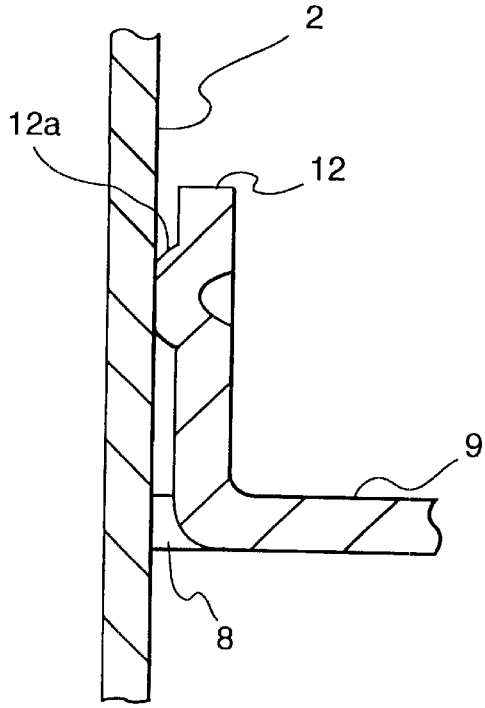
Figure 4:
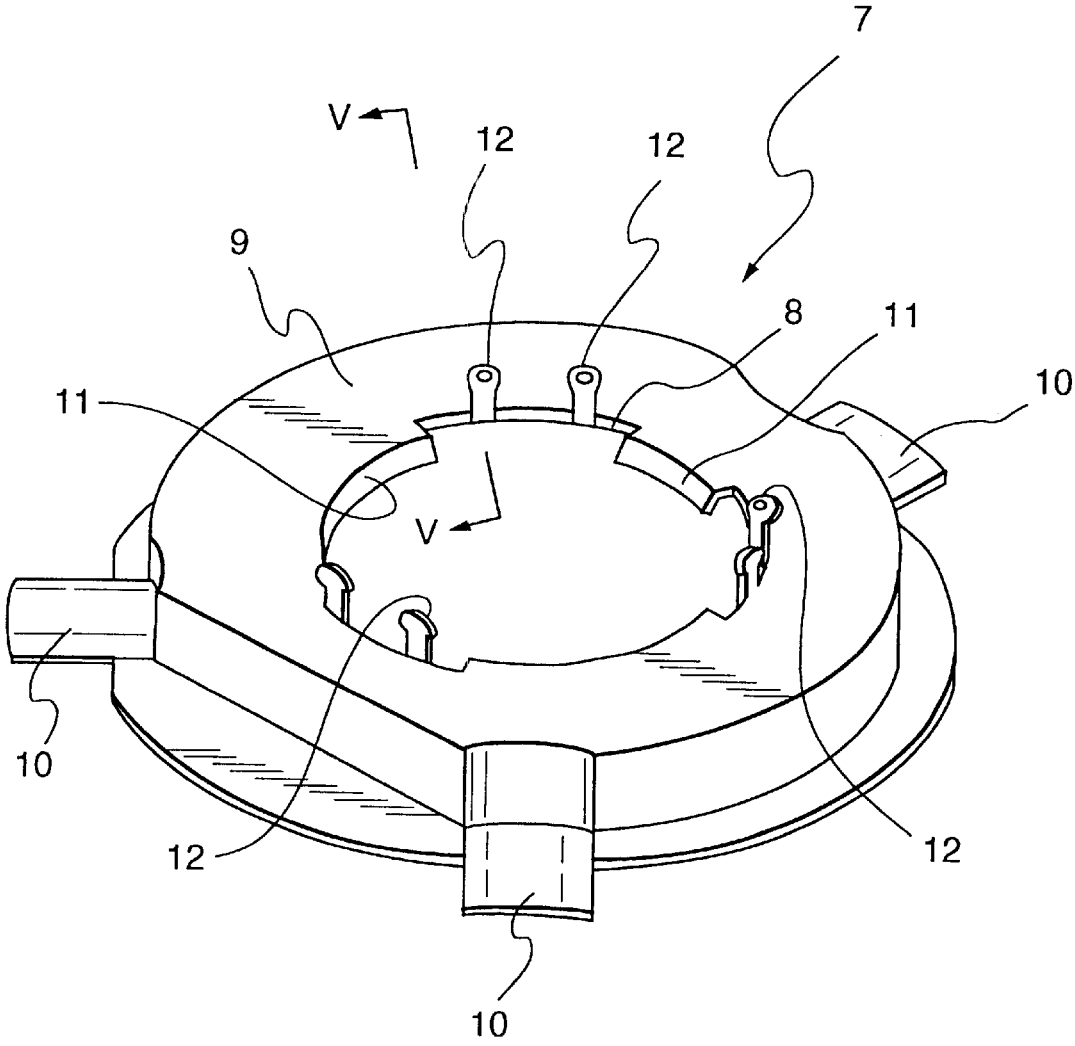

An electric light bulb with a base, according to embodiments of the invention, will be hereinbelow described in detail with reference to the drawings.

FIGS. 1 to 6 show a first embodiment 1 of an electric light bulb with a base, according to the invention.

A base 2 is formed of metal to be substantially cylindrical-shaped, and has a glass bulb 3 mounted at its one end. An end 2*a* of the base 2, to which the glass bulb 3 is mounted, is formed to slightly diverge outward. The other end of the base 2 or an end 2*b* opposite to that end, to which the glass bulb 3 is mounted, is closed by a closure plug 4, which is formed from an insulating material and from which lug terminals 5, 5, 5 are provided to extend. Filaments 6, 6 are enclosed in the glass bulb 3 and are connected to appropriate ones of the lug terminals 5, 5, 5.

A positioning ring 7 is securely mounted to the base 2.

The positioning ring 7 is formed by working a metallic sheet. The positioning ring 7 has an external shape which is substantially circular, and is formed at its central portion with a fitting hole 8, into which the base 2 is fitted. The positioning ring 7 comprises a small portion near an outer periphery thereof, a portion 9 extending upward (for the purpose of convenience, orientation is indicated herein such that a side, to which the glass bulb 3 is mounted, is upward, and a side opposite to the former side is downward the same shall apply with respect to a second embodiment described hereinafter.) from the small portion to the fitting hole 8, and three positioning projection pieces 10, 10, 10 provided outward to be disposed at positions suitably spaced circumferentially of the outer periphery of the positioning ring 7.

Three elastic pieces 11, 11, 11 are provided on an opening edge of the fitting hole 8 of the positioning ring 7 to be circumferentially spaced from one another and directed substantially downward. The elastic pieces 11, 11, 11 are slightly inclined in such a manner to have their tip ends approaching a center of the fitting hole.

Those portions of the opening edge of the fitting hole 8 of the positioning ring 7, which are disposed between the respective elastic pieces 11, 11, 11, are provided with weld pieces 12, 12 . . . which are directed upward. Each two of the weld pieces 12, 12 . . . are formed between the respective elastic pieces 11, 11, 11. Further, the weld pieces 12, 12 . . . are positioned not to overlap positions of the positioning projection pieces 10, 10, 10 in a circumferential direction of the positioning ring 7. That is, radial lines do not overlap one another which extend from a center of the positioning ring 7 to pass through the positions where the weld pieces 12, 12 . . . and the positioning projection pieces 10, 10, 10 are formed.

Figure 5:
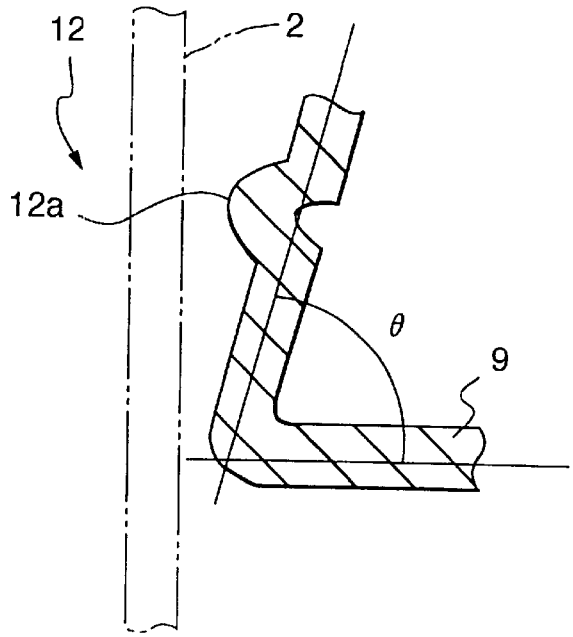
Figure 6:
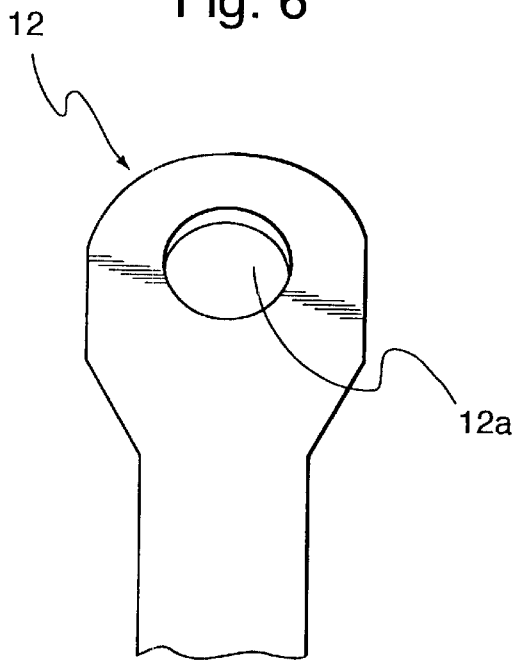

The respective weld pieces 12, 12 . . . are formed at positions near their tip ends with fusion projections 12*a* which extend toward the central axis of the positioning ring 7. Further, the tip ends of the weld pieces are formed to be substantially arcuate-shaped (see FIG. 6) so as to look visually small. Also, the weld pieces 12 before being welded to the base 2 are inclined so that their tip ends are positioned outwardly of the opening edge of the fitting hole 8 as shown in FIG. 5. In this case, the angle (of inclination is approximately 75 degrees.

The positioning ring 7 is secured to the base 2 in the following manner.

First, the positioning ring 7 is fitted onto the base 2 from below. At this time, the elastic pieces 11, 11, 11 abut resiliently against an outer periphery of the base 2 whereby the positioning ring 7 can be secured to the base 2 temporarily. At this time, the positioning ring 7 can be smoothly fitted onto the base 2. The reason for this is that being inclined outward as described above, the weld pieces 12, 12 . . . are prevented from being caught by the base 2 during the fitting action, and extending downward, the elastic pieces 11, 11, 11 permit slide pressures between the tip ends thereof and the base 2 to act to enlarge spacings between the tip ends of the elastic pieces 11, 11, 11.

Then welding is carried out by making positioning between the filaments 6, 6 and the positioning ring 7 and biasing the weld pieces 12, 12 . . . against the outer periphery of the base 2 after such positioning is established. Therefore, the positioning ring 7 is secured to the base 2.

At the time of the above welding, the weld pieces 12, 12 . . . having been inclined at an angle of substantially 75 degrees described above are made to have their tip ends disposed in substantially the same plane as the opening edge of the fitting hole 8 and become at substantially 90 degrees relative to the projecting portion 9.

With the positioning ring 7, the elastic pieces 11, 11, 11 for temporarily securing the positioning ring 7 to the base 2 and the weld pieces 12, 12 . . . for finally securing the positioning ring 7 to the base 2 are formed separately from each other, so that positioning for temporary securement is prevented from being displaced during the welding operation and so it is possible to accurately set the relative position of the positioning ring 7 to the base 2. That is, if one tongue piece served both as an elastic piece for temporary securement and a weld piece for welding, a fused portion would be produced between the tongue piece and the base at the time of welding in spite of such positioning whereby slippage would occur between the tongue piece and the base to make the tongue piece and the base out of position relative to each other. However, with the positioning ring 7, such a phenomenon will not occur.

Figure 7:
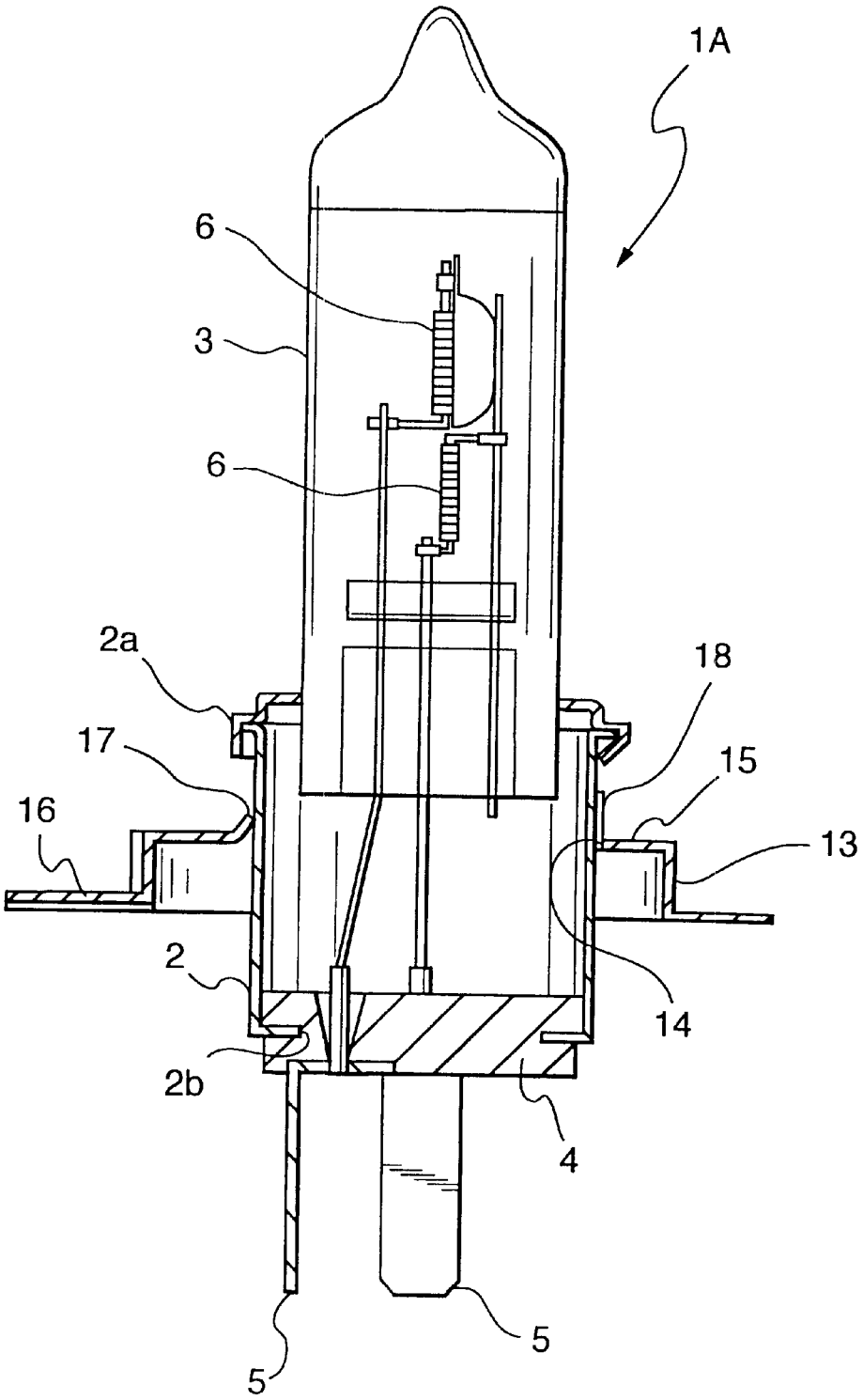
FIGS. 7 and 8 show a second embodiment of an electric light bulb with a base, according to the invention, FIG. 7 being a vertical cross sectional view of the second embodiment.
Figure 8:
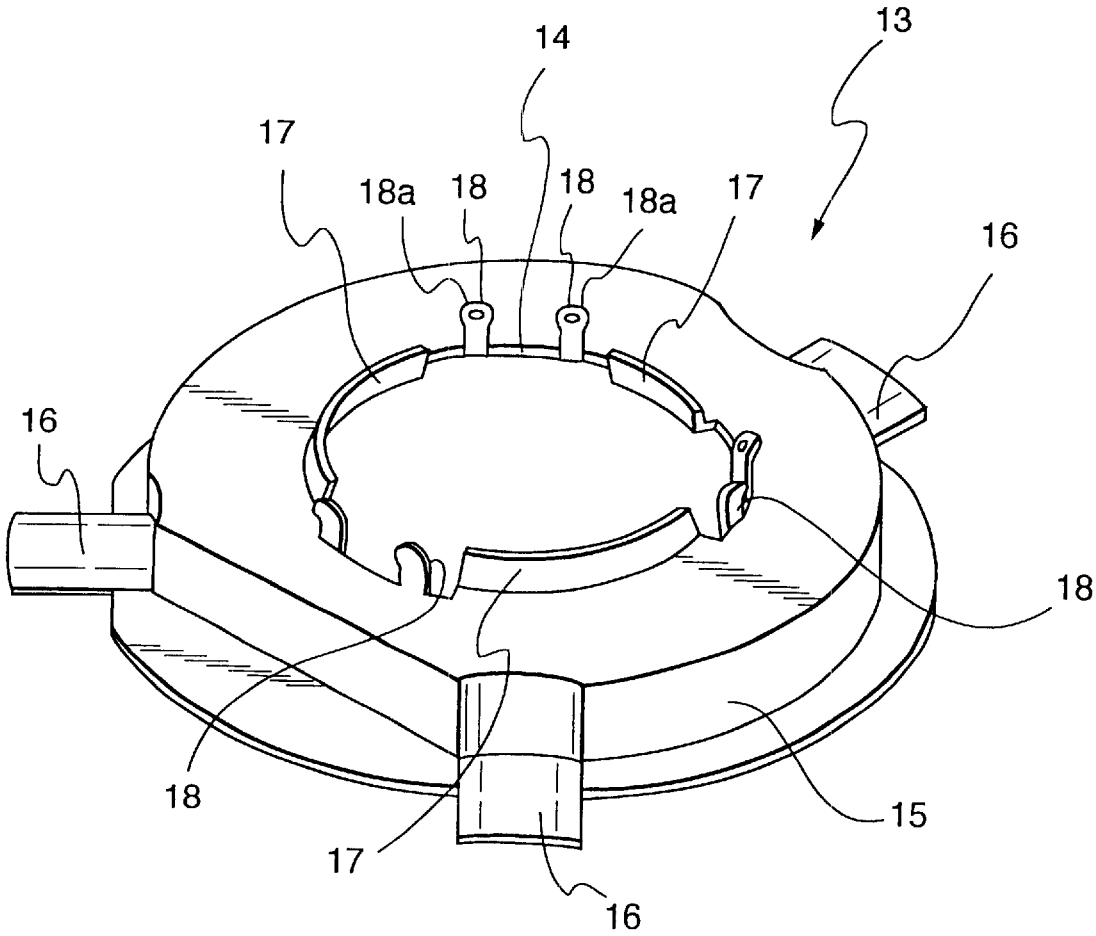
Figure 9:
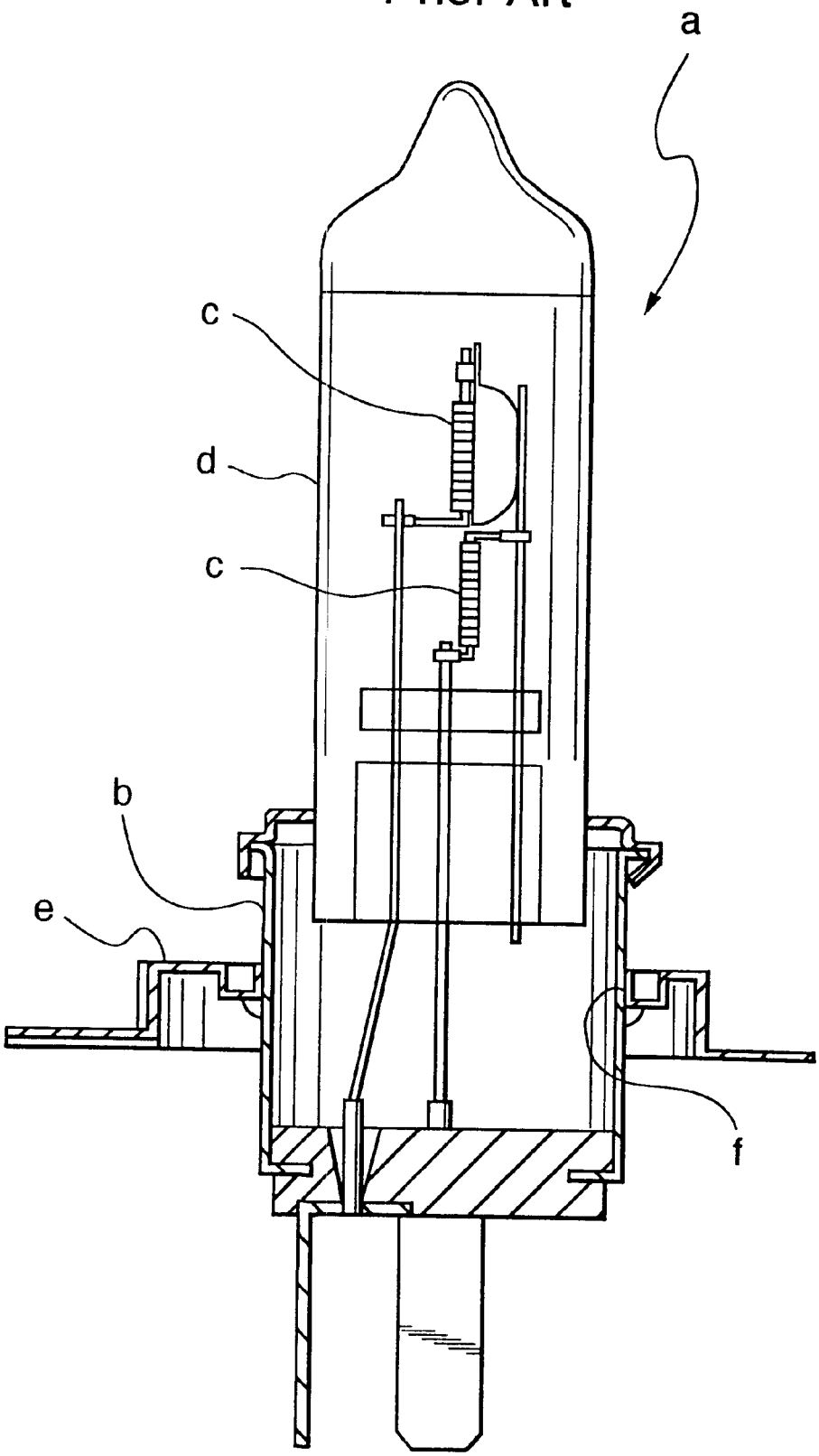
Fig. 9 Prior Art
FIG. 9 is a vertical cross sectional view showing an example of conventional electric light bulbs with a base.

FIGS. 7 and 8 show an electric light bulb with a base, according to a second embodiment 1A of the invention. Further, the second embodiment 1A is different from the first embodiment 1 with respect to a positioning ring but is similar to the first embodiment 1 with respect to other portions. Therefore, the different portion will be described in detail, and the other portions are designated by the same reference numerals as those in the first embodiment 1 and an explanation thereof is omitted A positioning ring 13 is formed by working a metallic sheet. The positioning ring 13 has an external shape which is substantially circular, and is formed at its central portion with a fitting hole 14, into which the base 2 is fitted. The positioning ring 13 comprises a small portion near an outer periphery thereof, a portion 15 extending upward from the small portion to the fitting hole 14, and three positioning projection pieces 16, 16, 16 provided outward to be disposed at positions suitably spaced circumferentially of the outer periphery of the positioning ring 13.

Three elastic pieces 17, 17, 17 are provided on an opening edge of the fitting hole 14 of the positioning ring 13 to be circumferentially spaced from one another and directed substantially upward. The elastic pieces 17, 17, 17 are slightly inclined in such a manner to have their tip ends approaching a center of the fitting hole.

Those portions of the opening edge of the fitting hole 14 of the positioning ring 13, which are disposed between the respective elastic pieces 17, 17, 17, are provided with weld pieces 18, 18 . . . which are directed upward. Each two of the weld pieces 18, 18 . . . are formed between the respective elastic pieces 17, 17, 17. Further, the weld pieces 18, 18 . . . are positioned not to overlap the positioning projection pieces 16, 16, 16 in a circumferential direction of the positioning ring 13. That is, radial lines do not overlap one another which extend from a center of the positioning ring 13 to pass through the positions where the weld pieces and the elastic pieces are formed.

The respective weld pieces 18 are formed to have the same shape as that of the weld pieces 12 in the first embodiment. That is, the weld pieces are formed at positions near their tip ends with fusion projections 18*a* which extend toward a central axis of the positioning ring 13. Further, the tip ends of the weld pieces are formed to be substantially arcuate-shaped so as to look visually small. Also, the weld pieces 18 before being welded to the base 2 are inclined so that their tip ends are positioned outwardly of the opening edge of the fitting hole 14. In this case, an angle of inclination is approximately 75 degrees.

The positioning ring 13 is secured to the base 2 in the following manner.

First, the positioning ring 13 is fitted onto the base 2 from below. At this time, the elastic pieces 17, 17, 17 abut resiliently against an outer periphery of the base 2 whereby the positioning ring 13 can be secured to the base 2 temporarily. At this time, being inclined outward as described above, the weld pieces 18, 18 . . . are prevented from being caught by the base 2 during the fitting action.

Thus welding is carried out by effecting positioning between the filaments 6, 6 and the positioning ring 13 and biasing the weld pieces 18, 18 . . . against the outer periphery of the base 2 after such positioning is established. Therefore, the positioning ring 13 is secured to the base 2.

Also, with the positioning ring 13, the elastic pieces 17, 17, 17 for temporarily securing the positioning ring 13 to the base 2 and the weld pieces 18, 18 . . . for finally securing the positioning ring 13 to the base 2 are formed separately from each other, so that positioning for temporary securement is prevented from being displaced during the welding operation and so it is possible to accurately set the relative position of the positioning ring 13 to the base 2 in the same manner as with the first embodiment 1.

As apparent from the above description, an electric light bulb with a base, according to the invention, comprises a positioning ring adapted to be mounted in externally fitted fashion to the cylindrical-shaped base which holds a glass bulb with filaments enclosed therein, the positioning ring comprising elastic pieces and weld pieces formed on a fitting hole, through which the base is inserted, the elastic pieces being adapted to resiliently abut against an outer peripheral surface of the base, the weld pieces being adapted to be welded to the outer peripheral surface of the base, and wherein the weld pieces are securely welded to the outer peripheral surface of the base after the elastic piece being made to abut against the outer peripheral surface of the base to be positioned.

Accordingly, with the electric light bulb with a base, according to the invention, the weld pieces are welded to the outer peripheral surface of the base to secure the positioning ring to the base, so that the use of solder is eliminated not to mar the environment. Also, the elastic pieces are provided separately from the weld pieces, and welding of the weld pieces is carried out in a state, in which the elastic pieces are made to abut against the outer peripheral surface of the base to be positioned, so that the positioning ring is prevented from being out of position relative to the base during the welding operation and so it is possible to make a mount position of the positioning ring stable.

In the invention as claimed in claim 2, the elastic pieces extend toward an end of the base opposite to the end where the glass bulb is held, so that it is possible to smoothly perform an action, in which the positioning ring is fitted onto the base to be secured thereto temporarily.

Further, in the invention as claimed in claim 3, the weld pieces extend toward an end of the base where the glass bulb is held, and are inclined such that tip ends of the weld pieces are positioned outwardly of base ends thereof before being welded to the base. Accordingly, the weld pieces will not present interference when the positioning ring is fitted onto the base to be secured thereto temporarily.

Therefore, the present examples and embodiments are to be considered as illustrative and not restrictive and the invention is not to be limited to the details given herein, but may be modified within the scope and equivalence of the appended claims.

What is claimed is:

1. An electric light bulb with a base, comprising a positioning ring adapted to be mounted in externally fitted fashion to the base which holds a glass bulb enclosing therein filaments, said positioning ring comprising elastic pieces and weld pieces formed on a fitting hole, through which said base is inserted, said elastic pieces being adapted to resiliently abut against an outer peripheral surface of said base, said weld pieces being adapted to be welded to the outer peripheral surface of said base, and wherein said weld pieces are securely welded to the outer peripheral surface of said base after said elastic pieces are made to abut against the outer peripheral surface of said base to be positioned.

2. The electric light bulb with a base, according to claim 1, wherein said elastic pieces extend toward an end of said base opposite to that end thereof, at which said glass bulb is held.

3. The electric light bulb with a base, according to claim 1, wherein said weld pieces extend toward that end of said base, at which said glass bulb is held, and are inclined such that tip ends thereof are positioned outwardly of base ends thereof before being welded to said base.

4. The electric light bulb with a base, according to claim 2, wherein said weld pieces extend toward that end of said base, at which said glass bulb is held, and are inclined such that tip ends thereof are positioned outwardly of base ends thereof before being welded to said base.

5. An electric light bulb as recited in claim 1, wherein said base is a metal base that is attached to the bulb.

6. A method of securing a light bulb having a base, comprising:

fitting the base of the light bulb inside an opening in a positioning ring, the positioning ring having elastic pieces and weld pieces, the light bulb being temporarily held relative to the positioning ring by the elastic pieces which resiliently contact the base;

moving the weld pieces from a first position where the weld pieces are spaced apart from the base to a second position where the weld pieces contact the base;

welding the weld pieces to an outer periphery of the base to secure the positioning ring to the base of the light bulb.

7. The electric light bulb with a base, according to claim 1, wherein:

said base is a metal base that is attached to the bulb, and wherein said elastic pieces and said weld pieces are adapted to grasp said metal base.

* * * * *